US006010375A

United States Patent [19]

Higuchi

[11] Patent Number: 6,010,375

[45] Date of Patent: Jan. 4, 2000

[54] CONNECTION CONSTRUCTION FOR A BATTERY AND AN ELECTRICAL CONNECTION BOX

[75] Inventor: Eiji Higuchi, Yokkaichi, Japan

[73] Assignee: Sumitomo Wiring Systems, Ltd., Japan

[21] Appl. No.: 09/103,744

[22] Filed: Jun. 24, 1998

[30] Foreign Application Priority Data

Jun. 30, 1997 [JP] Japan ..... 9-173665

[51] Int. Cl.[7] ..... H01R 4/42

[52] U.S. Cl. ..... 439/763; 439/949; 439/522

[58] Field of Search ..... 439/763, 764, 439/522, 949, 76.2

[56] References Cited

U.S. PATENT DOCUMENTS

| | | | |
|---|---|---|---|
| 5,094,635 | 3/1992 | Thompson et al. | 439/755 |
| 5,184,280 | 2/1993 | Fouad | 361/648 |
| 5,643,693 | 7/1997 | Hill et al. | 429/121 |
| 5,645,448 | 7/1997 | Hill | 439/522 |
| 5,882,213 | 3/1999 | Witek et al. | 439/76.2 |

FOREIGN PATENT DOCUMENTS

| | | |
|---|---|---|
| 40 18 856 | 12/1991 | Germany . |
| 2 284 313 | 5/1995 | United Kingdom . |

*Primary Examiner*—Steven L. Stephan
*Assistant Examiner*—T C Patel
*Attorney, Agent, or Firm*—Anthony J. Casella; Gerald E. Hespos

[57] ABSTRACT

A connection construction is provided to connect electrical connection paths of a battery and an electrical connection box using a connection plate. The connection construction for connects a battery post 11*a* projecting from the upper surface of a battery 11 and a power input portion of an electrical connection box 12 placed adjacent to the battery. A coupling portion 12*c* which extends along the upper surface of the battery 11 and projects from a side wall of the electrical connection box 12. A busbar 14 is connected with an internal circuit of electrical connection box 12 and extends into the coupling portion 12*c*. An end of the busbar 14 and a battery terminal 17 mounted on the battery post 1*a* are fixedly fastened by bolts via a connection plate 16.

5 Claims, 3 Drawing Sheets

CONNECTION CONSTRUCTION FOR A BATTERY AND AN ELECTRICAL CONNECTION BOX

BACKGROUND OF THE INVENTION

1. Field of the Invention

The present invention relates to a connection construction for a battery and an electrical connection box, and in particular to such a connection construction installed in an engine compartment of an automotive vehicle. The connection construction is design particularly to improve operability by directly connecting electrical connection paths of the battery and the electrical connection box using a connection plate and to take up a displacement of the battery and the electrical connection box during the connecting operation.

2. Description of the Prior Art

A battery and an electrical connection box installed in an engine compartment generally are fixed separately to a vehicle body as shown in FIG. 4. A battery post la serving as an electrode of a battery 1 and a power input portion 2*a* of an electrical connection box 2 are connected by a battery cable C having a battery terminal 3*a* and an terminal 3*b* secured at the respective ends thereof. The Japan Industrial Standard (JIS) employs the abbreviation LA to describe a terminal fitting intended for automotive use and having a ring-shaped connection portion through which a bolt passes. The terminal 3*b* is of that general construction, and will be referred to herein as an LA terminal. The respective terminals 3*a* and 3*b* are fastened to the battery post 1*a* and the power input portion 2*a* by bolts 4*a*, 4*b*.

However, with the connection construction using the above battery cable, a special cable having the LA terminal 3*b* secured needs to be prepared. Further, when the LA terminal 3*b* is connected with the electrical connection box 2, an operator has to press the LA terminal 3*b* for positioning by one hand while maneuvering a fastening tool by the other hand. This causes poor operability.

In view of the above problem, an object of the present invention is to provide a connection construction which can connect electrical connection paths of a battery and an electrical connection box via a conductive connection plate without using a special battery cable having an LA terminal secured. Another object is to provide a connection construction designed to have an improved operability by taking up a displacement of the battery and the electrical connection box during the connecting operation.

SUMMARY OF THE INVENTION

According to the invention, there is provided a connection construction for connecting a battery post projecting from a battery to a power input portion of an electrical connection box substantially placed adjacent to or on the battery. The connection construction includes a coupling portion that projects from the electrical connection box. A busbar is connected or connectable with an internal circuit of the electrical connection box, and extends substantially into the coupling portion. A battery terminal is mounted on the battery post, and a connection plate is fixedly fastened to the battery terminal by an appropriate fastener. Portions of the connection plate and the busbar are placed substantially one over the other in directions at an angle different from 0° or 180°, preferably substantially normal to each other to define a joint portion. The respective overlapped portions are formed with oblong holes through which an additional fastener extends. The combination of the fastener and oblong holes enable the connection construction to take up relative displacement between the battery and the electrical connection box in the joint portion.

According to a preferred embodiment, the oblong holes extend along the lengthwise direction of the respective connection plate and the busbar. Preferably, the oblong holes are provided in the respective connection plate and the busbar for the insertion of one or more bolts to movably connect or mount the connection plate and busbar.

The coupling portion may project from a side wall of the electrical connection box. Preferably, the connection plate is arranged in or through an opening provided in the coupling portion.

Most preferably, the coupling portion extends substantially on or along the battery, and preferably the upper surface thereof.

According to a further preferred embodiment, there is provided a connection construction for connecting a battery post projecting from the upper surface of a battery and a power input portion of an electrical connection box placed adjacent to the battery. The connection construction includes a coupling portion which extends along the upper surface of the battery and projects from a side wall of the electrical connection box. A busbar connected with an internal circuit of the electrical connection box extends into the coupling portion, and an end of the busbar and a battery terminal mounted on the battery post are fixedly fastened by bolts via a connection plate. The connection plate and the busbar are substantially adjacent at a joint portion where ends of the connection plate and the busbar are placed one over the other in directions normal to each other. The respective ends are formed with oblong holes extending along the lengths of the connection plate and the busbar for the insertion of bolts so as to take up the displacement of the battery and the electrical connection box in the joint portion.

Specifically, the mount hole formed at one end of the busbar is fitted to a bolt placed in the coupling portion projecting from the electrical connection box so as to face upwardly. The connection plate is assembled by fitting the bolt hole formed at one end of the connection plate to the bolt so as to be placed on the busbar while the other end of the connection plate projects outwardly of the coupling portion. Then, the connection plate is positioned with respect to the battery terminal, and connecting portions at the opposite ends of the connection plate are fastened to the bolts by nuts.

With the above construction, the battery and the electrical connection box can be connected via the connection plate without necessitating a battery cable equipped with an LA terminal. During the connecting operation, since the connecting positions can be specified by the opposite ends of the connection plate, the bolt fastening operation by a tool can be stably and efficiently performed.

Further, as described above, the joint portion comprises ends of the connection plate and the busbar that are placed one over the other in directions normal to each other. The respective ends are formed with oblong holes extending along the lengths of the connection plate and the busbar for the insertion of a bolt. The oblong holes take up the displacement of the battery and the electrical connection box in the joint portion. With this construction, the busbar and the connection plate can be moved with respect to each other in all directions in a specified planar range in the joint portion since the oblong holes for the insertion of the bolt extend in directions normal to each other. Thus, a displacement resulting from the fact that the battery and the electrical connection box are separately fixed to a body can be taken up adjustably by the joint portion.

According to a further preferred embodiment, there is a construction for connecting a battery and an electrical connection box in an adjacently disposed relationship. At least one battery post projects from the battery. At least one power input bar is connected electrically with an internal circuit of the electrical connection box and extends from the electrical connection box. Portions of the power input bar spaced from the electrical connection box include at least one elongate through hole. The connection further comprises at least one connection plate having a first portion connected to the battery post, and a second portion with at least one elongate through hole formed therethrough. The connection plate is superimposed on the power input bar at an angle different from 0° and 180° such that the elongate through hole in the connection plate is at least partly registered with the second elongate through hole in the power input bar. At least one electrically conductive fastener passes through the first and second elongate through holes for securing the connection plate and the power input bar in an electrically connected condition.

According to still a further preferred embodiment, an electrical connection assembly is provided for supplying power from a battery to an electrical connection box. The battery has at least one surface with at least one battery post projecting from said surface, and the electrical connection box includes internal circuitry therein. The assembly comprises a substantially box-shaped coupling portion projecting from said electrical connection box and being positioned on said surface of said battery. The box-shaped coupling portion has a bottom wall and at least one side wall projecting from the bottom wall. The side wall has at least one opening extending therethrough. A busbar is provided with a first portion extending into connection with the internal circuitry of the electrical connection box and a second portion extending into said box-shaped coupling portion of said electrical connection box. The second portion of said busbar includes an oblong hole. An electrically conductive bracket connects to the battery post and has a bracket bolt mounted thereto. The bracket bolt extends substantially orthogonally to the surface of the battery. A connection plate extends through the opening in the box-shaped coupling portion of the electrical connection box. The connection plate has at least first and second holes extending therethrough. The first hole of the connection plate is secured on the bracket bolt. The second hole of said connection plate is oblong and is at least partly registered with the oblong hole in the busbar. A connection bolt passes through the oblong holes for securely fastening the busbar to the connection plate and thereby provides electrical connection between the battery post and internal circuitry of the electrical connection box.

These and other objects, features and advantages of the present invention will become more apparent upon a reading of the following detailed description and accompanying drawings.

DETAILED DESCRIPTION OF THE PREFERRED EMBODIMENTS

Figure 1A:
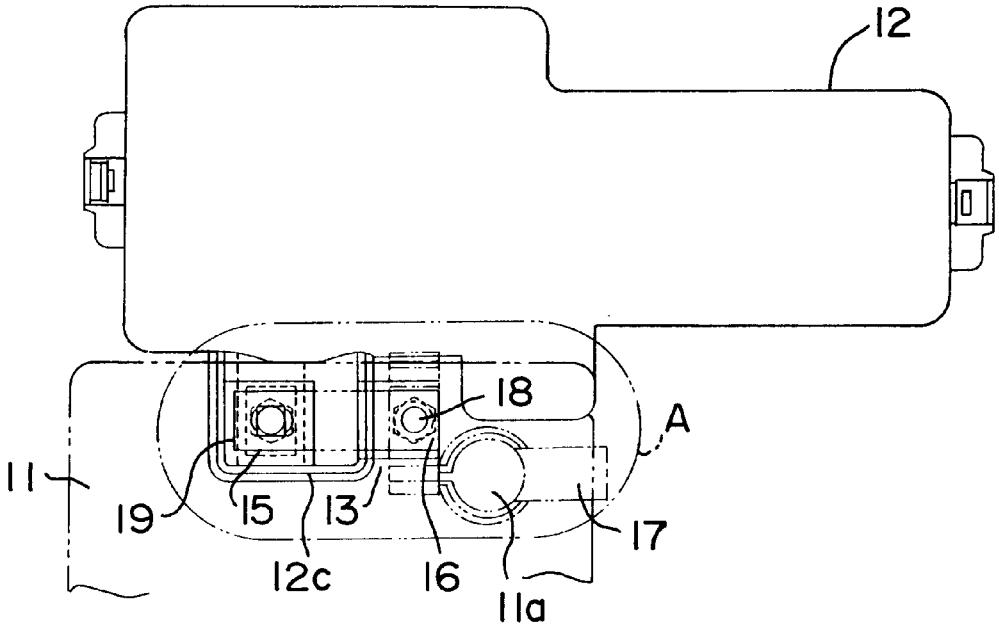
FIG. 1(A) is a plan view partly in section of one embodiment of a connection construction with an electrical connection box according to the invention and FIG. 1(B) is an enlarged view of a portion A of FIG. 1(A).
Figure 1B:
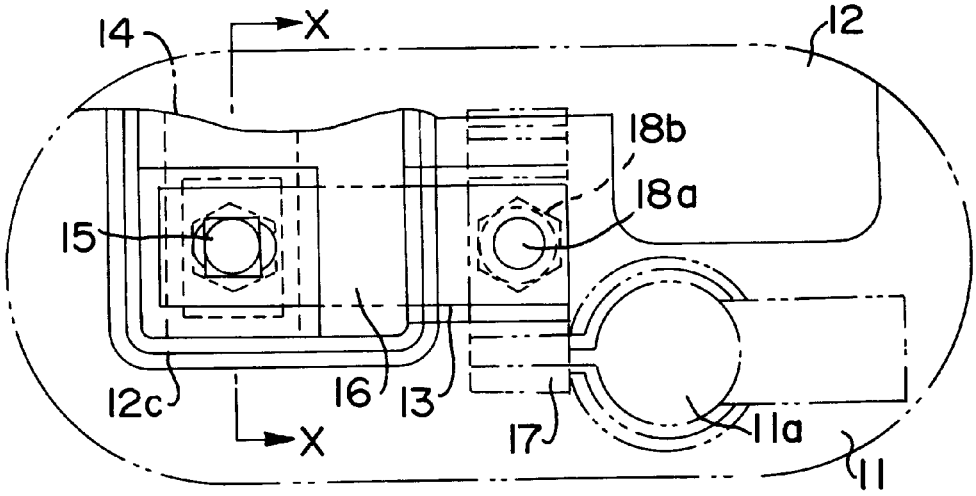
Figure 2:
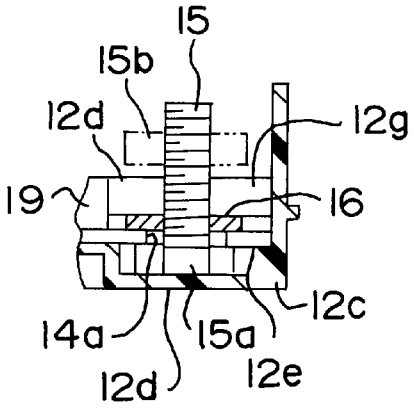
FIG. 2 is a section along X—X of FIG. 1(B).
Figure 4:
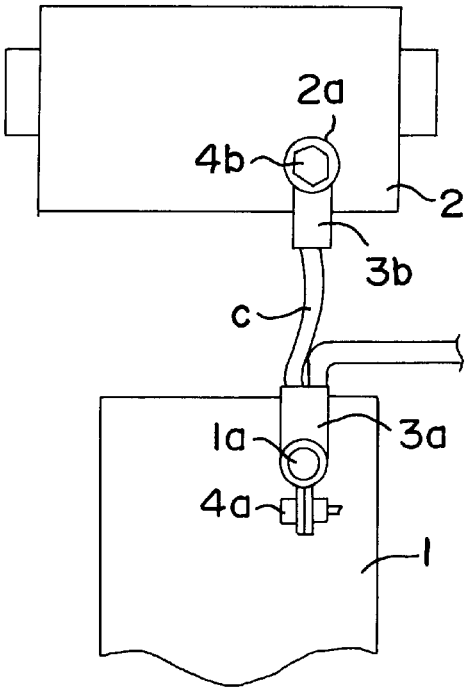
FIG. 4 PRIOR ART
FIG. 4 is a plan view of a prior art construction connection.
Figure 3:
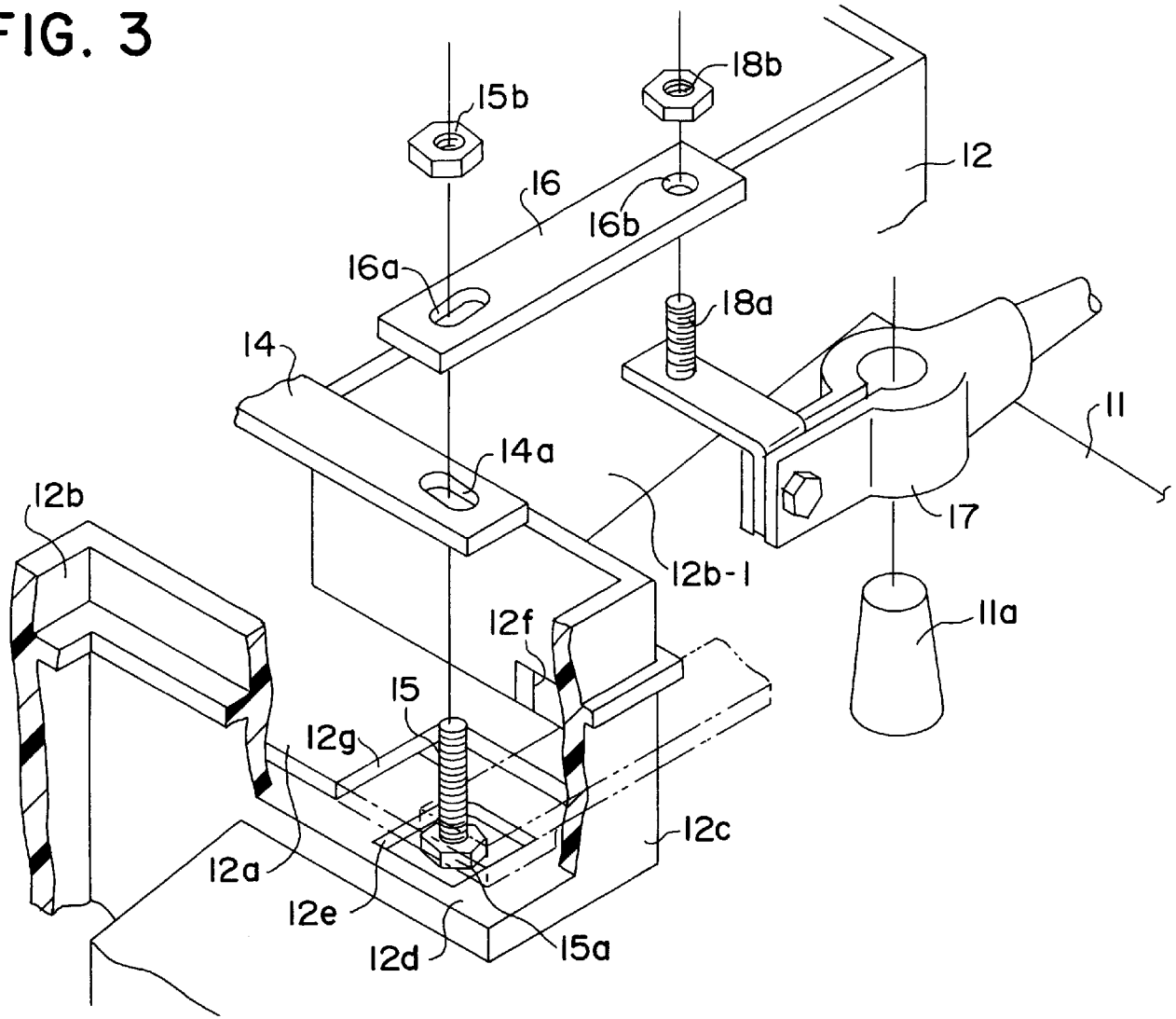
FIG. 3 is an exploded perspective view of an essential portion.

A connection construction in accordance with the invention is illustrated in FIGS. 1–3 and is provided to connect electrical connection portions of a battery 11 and/or some other electric circuit with an electrical connection box 12. The battery 11 and the electrical connection box 12 preferably are installed substantially adjacent to each other in an engine compartment of an automotive vehicle and preferably are fixed separately to a vehicle body. The battery 11 and the electrical connection box 12 are connected by a connection member 13 which is not a cable. The electrical connection portion of the battery 11 is a battery post 11*a*, which is one of a pair of electrodes that projects preferably from the upper surface of the battery 11. The electrical connection portion of the electrical connection box 12 is a busbar 14 that is connected as a power input portion with internal circuits of the electrical connection box 12.

The electrical connection box 12 is comprised of an upper casing 12*a* fitted with electric or electronic devices and a substantially box-shaped lower casing 12*b* in which the upper casing 12*a* is accommodated. A side wall 12*b*-1 of the lower casing 12*b* facing toward the battery 11 is formed integrally or unitarily with a substantially box-shaped coupling portion 12*c* which projects substantially along the upper surface of the battery 11 and faces the battery post 11*a* or is adjacent thereto.

A bolt 15 is so placed as to face upwardly in a position at the leading end of a bottom wall 12*d* of the coupling portion 12*c*. In conformity with or substantially corresponding to the bolt 15 there is formed an opening or cut-out portion 12*g* in a wall of the upper casing 12*a*. The bottom wall 12*d* is formed with an oblong groove 12*e* in conformity with or substantially corresponding to a head 15*a* of the bolt 15, such that the head 15*a* is substantially movable at least along the length of the coupling portion 12*c*. On the other hand, the busbar 14 projects over or along the bottom wall 12*d* of the coupling portion 12*c* and an oblong hole 14*a* extending along the length of the busbar 14 is formed at an end of the busbar 14 for the insertion of the bolt 15.

The connection member 13 is comprised of an elongate electrically conductive connection plate 16 and a battery terminal 17 to be secured to the battery post 11*a*. An oblong hole 16*a* is formed through one end of the connection plate 16 and extends substantially longitudinally along the connection plate 16. The oblong hole 16*a* is used to receive the bolt 15. On the other hand, a bolt 18*a* extends from the battery terminal 17 and through a bolt hole 16*b* in the connection plate 16. The bolt 18*a* is used with a nut 18*b* to secure the connection plate 16 to the battery terminal 17. The bolt hole 16*b* preferably is formed substantially at the end of the connection plate 16 opposite the oblong hole 16*a*.

As shown in FIG. 3, the end of the connection plate 16, where the oblong hole 16*a* is formed, is introduced through an opening 12*f* formed in a side wall of the coupling portion 12*c* substantially facing or adjacent to the battery post 11*a*. The end of the connection plate 16 then is placed on the end of the busbar 14 so as to extend in a direction at an angle different from 0° or 180°, preferably substantially normal to the extension of the busbar 14 as shown in phantom line in FIG. 3. The bolt 15 then is inserted through the oblong hole 14*a* of the busbar 14 and through the oblong hole 16*a* of the connection plate 16 to form a joint portion 19 (FIG. 1(A)) which can be fastened by a nut 15*b*. With the busbar 14 and the connection plate 16 substantially placed one over the other in the area of the joint portion 19, an end of the upper casing 12*a* is placed in the coupling portion 12*c* so as to be placed substantially on the connection plate 16.

Next, a process of electrically connecting the battery post 11*a* of the battery 11 and the busbar 14 of the electrical connection box 2 is described. The battery 11 is fixed to the vehicle body and the battery terminal 17 is fastened to the battery post 11*a* by a bolt. On the other hand, in the area of the joint portion 19 in the coupling portion 12*c* of the electrical connection box 12, the connection plate 16 is joined with the busbar 14 in such a manner as to be movable due to the presence of the oblong holes 14*a*, 16*a* and so as to be nevertheless electrically connected. The other end of the connection plate 16 projects outwardly from the side wall of the coupling portion 12*c*. In other words, the electrical contact is substantially ensured and the connection plate 16 and the busbar 14 are movable with respect to each other and/or with respect to the electrical connection box 12 thus allowing for a relative movement or adaptation of the battery post 17*a* and bolt 15.

The electrical connection box 12 in this state is fixedly mounted on the vehicle body by placing the coupling portion 12*c* on the upper surface of the battery 11 and fitting the bolt hole 16*b* at the other end of the connection plate 16 projecting from the coupling portion 12*c* down on the bolt 18*a* of the battery terminal 17. At this time, since the connection plate 16 is movable with respect to the busbar 14 in a specified range in all planar directions by the action of the oblong holes 14*a*, 16*a*, the bolt hole 16*b* of the connection plate 16 can be positioned with respect to the bolt 18*a*.

Subsequently, by screwing the nuts 15*b*, 18*b* down on the bolts 15, 18*a* inserted at the opposite ends of the connection plate 16 by a tool (not shown), the busbar 14 and the battery terminal 17 can be mechanically and electrically connected via the connection plate 16.

As is clear from the above description, the invention connection construction for the battery and the electrical connection box can directly connect the electrical connection paths of the battery and the electrical connection via the connection plate projecting from the electrical connection box and, accordingly, does not require a special battery cable. This connecting operation can be performed by fastening the opposite ends of the connection plate by bolts on the upper surface of the battery. Since the connection plate does not twist during the fastening operation unlike the battery cable, operability can be improved. Further, the displacement of the battery and the electrical connection box can be taken up by the oblong holes at the joint portion of the busbar and the connection plate.

What is claimed is:

1. A connection construction for connecting a battery post projecting from a battery and a power input portion of an electrical connection box placed substantially adjacent to the battery, the connection construction comprising:

a coupling portion projecting from the electrical connection box, the connection box being formed with an opening formed through the coupling portion thereof, an elongated busbar connected with an internal circuit of the electrical connection box, and extending substantially into the coupling portion, a battery terminal mounted on the battery post, and an elongated connection plate extending through the opening in the coupling portion of the connection box and having one end fixedly fastened by a fastener to the battery terminal, portions of the connection plate and the busbar being placed substantially one over the other in directions at an angle different from 0° and 180° with respect to each other, and the respective portions being formed with oblong holes, the oblong holes having long axes that extend along directions of elongation of the respective connection plate and the busbar such that the oblong holes overlie one another with their long axes aligned at an angle different from 0° and 180°, a bolt passing through the respective oblong holes for adjustably connecting the connection plate and the busbar.

2. A connection construction according to claim 1, wherein the coupling portion projects from a side wall of the electrical connection box.

3. A connection construction according to claim 1, wherein the coupling portion substantially extends along an upper surface of the battery.

4. A construction for connecting a battery and an electrical connection box in an adjacently disposed relationship, the electrical connection box having a main body and a coupling portion projecting therefrom, at least one battery post projecting from the battery, said construction comprising:

a power input bar electrically connected with an internal circuit of the electrical connection box and extending from the main body of the electrical connection box to the coupling portion thereof, portions of the power input bar spaced from the main body of the electrical connection box including a first elongate through hole aligned to extend along a length direction of the power input bar;

an electrically conductive bracket connected to said battery post and having a bracket bolt mounted thereon;

an elongated connection plate having a first end portion connected to the bracket bolt, and a second end portion having a second elongate through hole formed therethrough, the second elongate through hole having an elongate axis aligned with a direction of elongation of the elongated connection member, the connection plate being superimposed on the power input bar at an angle different from 0° and 180° such that the first elongate through hole is at least partly registered with the second elongate through hole; and a fastener passing through the first and second elongate through holes for adjustably securing the connection plate and the power input bar in electrically connected condition.

5. An electrical connection assembly for supplying power from a battery to an electrical connection box, said battery having at least one surface with at least one battery post projecting from said surface, said electrical connection box including internal circuitry therein, said assembly comprising:

a substantially box-shaped coupling portion projecting from said electrical connection box and being positioned on said surface of said battery, said box-shaped coupling portion having a bottom wall and at least one side wall projecting from said bottom wall, said side wall having at least one opening extending therethrough;

a busbar having a first portion extending into connection with the internal circuitry of the electrical connection box and having a second portion extending into said box-shaped coupling portion of said electrical connection box, said second portion of said busbar including an oblong hole;

an electrically conductive bracket connected to said battery post and having a bracket bolt mounted thereto, said bracket bolt extending substantially orthogonally to said surface of said battery;

a connection plate extending through said opening in said box-shaped coupling portion of said electrical connection box, said connection plate having at least first and second holes extending therethrough, said first hole of said connection plate being secured on said bracket bolt, said second hole of said connection plate being oblong and being at least partly registered with the oblong hole in the busbar; and a connection bolt passing through said oblong holes for securely fastening the busbar to the connection plate and thereby providing electrical connection between the battery post and internal circuitry of the electrical connection box.

* * * * *